United States Patent [19]

Greene et al.

[11] Patent Number: 4,993,500

[45] Date of Patent: Feb. 19, 1991

[54] AUTOMATIC DRIVE HAMMER SYSTEM AND METHOD FOR USE THEREOF

[75] Inventors: R. Richard Greene, Indianapolis; Rick Sams, Greenfield, both of Ind.

[73] Assignee: Mobile Drilling Company, Inc., Indianapolis, Ind.

[21] Appl. No.: 329,346

[22] Filed: Mar. 27, 1989

[51] Int. Cl.[5] ..... E21B 49/02

[52] U.S. Cl. ..... 173/1; 173/21; 173/28; 173/84; 173/86; 173/124

[58] Field of Search ..... 173/1, 21, 28, 84, 86, 173/89, 124, 128, 132, 133, 92

[56] References Cited

U.S. PATENT DOCUMENTS

| | | | |
|---|---|---|---|
| 2,599,995 | 6/1952 | Hobson et al. . | |
| 2,833,120 | 5/1958 | Barrett et al. | 173/89 |
| 2,849,212 | 8/1958 | Robbins . | |
| 2,952,132 | 9/1960 | Urban | 173/124 X |
| 3,205,952 | 9/1965 | Sicotte | 173/124 |
| 3,216,511 | 11/1985 | Ladd et al. | 173/19 |
| 3,369,616 | 2/1968 | McGonigal et al. | 173/124 |
| 3,543,868 | 12/1970 | Drake | 173/2 |
| 3,576,218 | 4/1971 | Lisenby | 173/28 |
| 3,696,873 | 10/1972 | Anderson | 173/21 X |
| 3,732,935 | 5/1973 | Gibson | 173/28 |
| 3,754,604 | 8/1973 | Inaba et al. | 173/28 |
| 3,835,940 | 9/1974 | Winter, Jr. | 175/85 |
| 3,867,989 | 2/1975 | Hisey et al. | 175/147 |
| 3,889,765 | 6/1975 | Henson | 175/257 |
| 4,076,081 | 2/1978 | Schnell | 173/134 |
| 4,191,263 | 3/1980 | Malterer | 173/21 |
| 4,258,796 | 3/1981 | Horning et al. | 175/52 |
| 4,405,020 | 9/1983 | Rassieur | 173/89 |
| 4,421,180 | 12/1983 | Fleishman et al. | 173/124 |

*Primary Examiner*—Douglas D. Watts
*Assistant Examiner*—Rinaldi Rada
*Attorney, Agent, or Firm*—Barnes & Thornburg

[57] ABSTRACT

An automatic drive hammer system includes an automatic drive hammer apparatus which is carried by a bucket pivotally mounted to a drill rig. The drive hammer apparatus may be pivoted in the bucket from an off-hole storage position to an on-hole loading/unloading position whereby the drive hammer apparatus is lifted out of the bucket by a winch assembly and the bucket is pivoted to the off-hole storage position. An anvil and connector connects to a drill string and sampler which extend upwardly from a hole in the ground. The drive hammer apparatus has a housing which contains a hammer adapted for reciprocal sliding movement therewithin to cyclically strike the anvil to drive the anvil, drill string and sampler combination into the ground. A trip rail is rigidly attached to the anvil and extends within the housing. A follower assembly is pivotally mounted to the hammer. A hammer drop system cyclically lifts the hammer via the follower assembly off the anvil and when the follower assembly reaches the top of the trip rail, the follower assembly falls away from the hammer drop system allowing the hammer to free fall and strike the anvil.

39 Claims, 4 Drawing Sheets

AUTOMATIC DRIVE HAMMER SYSTEM AND METHOD FOR USE THEREOF

FIELD OF THE INVENTION

The present invention relates to the field of drive hammer systems and in particular, to an apparatus for obtaining a representative soil sample and a measure of the resistance of the soil to penetration of the sampler.

BACKGROUND OF THE INVENTION

Prior to erecting certain structures, the nature of the underlying soil should be examined in order to determine the type of footings and foundations required to properly support the structure. Customarily, a Standard Penetration Test or SPT is performed whereby a split-barrel sampler is driven into the soil to obtain a representative soil sample and to measure the resistance of the soil by recording the number of blows required to drive the sampler a specified distance. ASTM Standard D 1586-84 provides, in part, that a hammer weighing 140±2 lb. (63.5±1 kg) be successively lifted and dropped 30±1 in. (0.76 m±25 mm) unimpeded onto an anvil which is attached to the top of a sampling rod string.

The lifting and dropping of the hammer to produce the blow is accomplished by a hammer drop system. ASTM Standard D 1586—84 recognizes and approves several such systems — rope-cathead, trip, semi-automatic, or automatic hammer drop system, providing that the lifting apparatus must not cause penetration of the sampler while re-engaging and lifting the hammer. The disadvantages inherent in each of the above systems are well known in the industry. For example, the rope-cathead system, while allowing 40–60 blows per minute, may often be inaccurate. The lifting and dropping of the hammer is controlled by an operator who holds onto one end of a rope. The rope is wound once or twice around a revolving drum or cathead and extends therefrom to the weight. By pulling slightly on the rope, the friction between the rope and the revolving drum assists the operator in lifting the hammer. When the hammer has been raised 30 inches, the operator quickly releases the rope, allowing the hammer to drop and strike the anvil. However, an inattentive operator may release the rope too early or too late relative to the 30 inch drop requirement, he may not release the rope quickly enough or completely, and there may be residual friction between the drum and the rope during the drop. Each of these events may change the energy transmitted to the anvil which in turn compromises the accuracy of the test results.

Most of the accuracy of the test is regained by "automatic" hammer drop systems whereby the lifting and dropping of the hammer is performed entirely by some combination of mechanical, electrical and hydraulic components. An example of such systems is described in U.S. Pat. No. 4,405,020 issued to Rassieur wherein a single lifting lug is mounted on a two-sprocket chain drive. The chain, sprockets, hammer and a motor for driving the sprockets are all carried by a hammer guide housing which is held by a carriage which is pivotally and vertically slidably mounted to a vertical member. As the lug comes around the lower sprocket onto the inward side of the drive chain, it engages the lower striking surface of the hammer, lifting the hammer off the anvil and upward through the hammer guide housing. When the lug reaches and moves around the top sprocket, it moves away from the hammer allowing the hammer to free fall and strike the anvil. The drop height of the hammer for each lift/drop cycle is thus determined by the fixed distance between the sprockets.

After impact and the associated incremental drop of the anvil and drill string, the drive chain assembly must be lowered precisely a corresponding amount so that the lug will properly engage the hammer in the next cycle and so that the hammer may be lifted the required 30 inches. A hydraulic system with adjustable relief valve is provided to govern the movement of the carriage and thereby hammer drop system on the vertical member. This system nevertheless requires monitoring by the operator to provide an acceptable level of accuracy of the test. Further, it is not clear that the hydraulic system with adjustable relief valve is completely successful in assuring that the lifting apparatus will not transfer energy to the sampler and cause penetration of the sampler while re-engaging and lifting the hammer.

What is needed is a drive hammer system which is better able to meet the standards and requirements of the Standard Penetration Test.

SUMMARY OF THE INVENTION

Generally speaking, an automatic drive hammer system is provided to perform a Standard Penetration Test in an improved manner.

A support bucket is pivotally mounted to the support structure of a drill rig to hold an automatic drive hammer apparatus in an off-hole, storage position and to pivot the drive hammer apparatus to a loading/unloading position substantially over the working hole. The drive hammer apparatus is lifted out of the bucket and the support bucket is then pivoted back to the off-hole storage position. The drive hammer apparatus has a housing which holds a hammer for reciprocal sliding movement therewithin to cyclically strike an anvil connected to a drill string and sampler combination to drive the anvil, drill string and sampler combination into the earth. A trip rail is rigidly attached to the anvil and extends along one inside surface of the housing. A follower assembly is pivotally mounted atop the hammer and has a follower wheel adapted to follow the trip rail. A hammer drop system includes a hydraulically driven endless chain with pick-ups which engage the follower assembly and lift the hammer off the anvil. When the follower assembly reaches the top of the trip rail, the follower assembly falls away from the hammer drop system allowing the hammer to free fall a predetermined height and strike the anvil. Throughout the operation of the drive hammer apparatus, the housing and drop hammer system are held suspended and vertically stationary over the hole by the winch assembly.

It is an object of the present invention to provide an improved automatic drive hammer system.

It is another object of the present invention to provide an automatic drive hammer system wherein the lifting apparatus does not cause penetration of the sampler while re-engaging and lifting the hammer.

Other objects and advantages of the present invention will become apparent from the following description of the preferred embodiment.

DESCRIPTION OF THE PREFERRED EMBODIMENT

Figure 1:
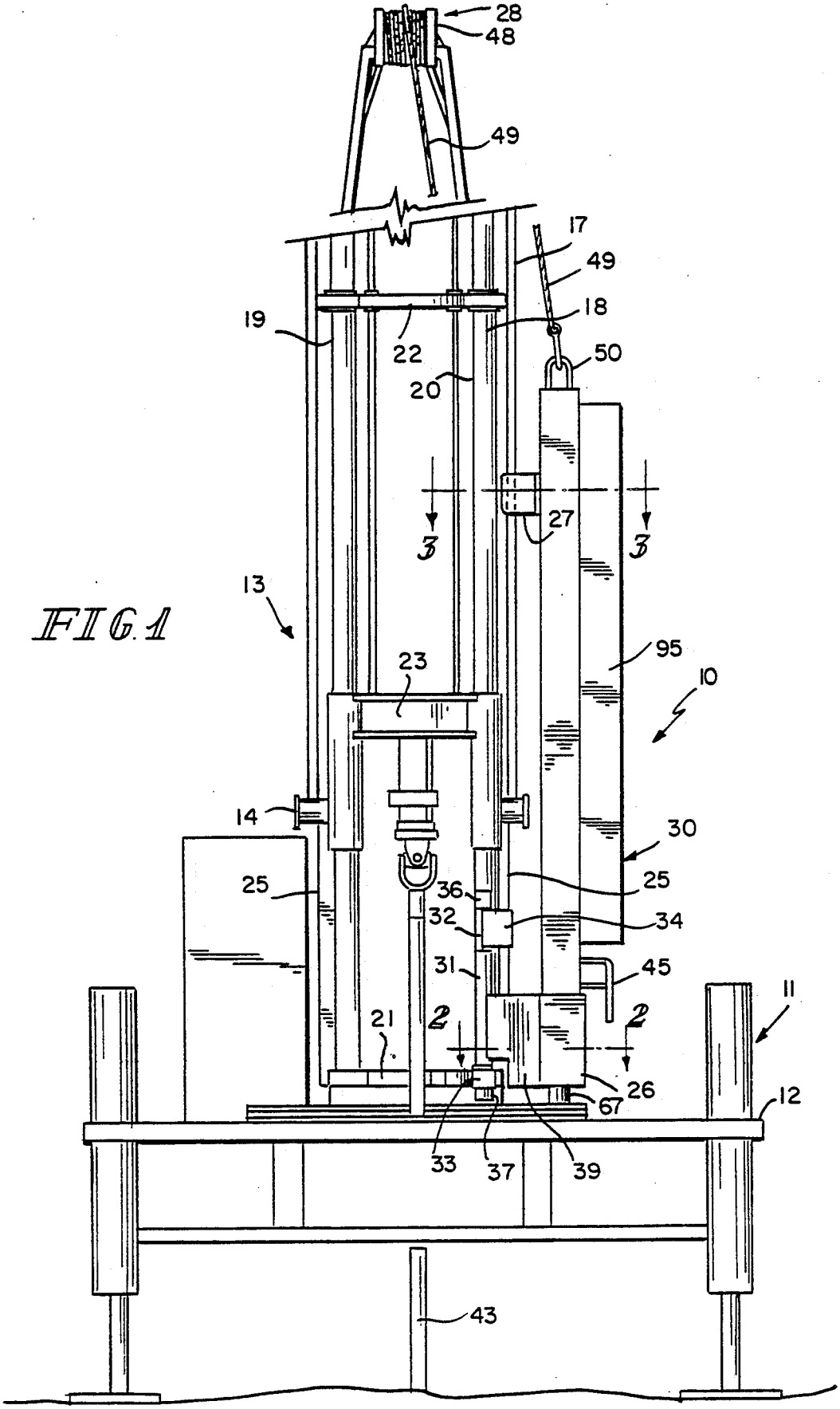
FIG. 1 is a rear elevational view of drill rig adapted with the drive hammer system of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1 there is shown an automatic drive hammer system 10 adapted to operate from the rear of a truck-mounted earth drilling rig 11 in accordance with one embodiment of the present invention. One commercially available unit which may be adapted to receive automatic drive hammer system 10 in accordance with the present invention is a Model B-57 Multi-Purpose Drill available from Mobile Drilling Co., Inc., 3807 Madison Avenue, Indianapolis, Indiana 46227. A standard B-57, for purposes of the present description, normally includes a bed 12 and a support frame (not shown) which extends upwardly from bed 12 and supports a mast assembly 13 at hinge joint 14. Mast assembly 13 generally includes mast 17 and feed frame assembly 18. Feed frame assembly 18 includes a pair of feed hydraulic cylinders 19 and 20, guide plate 21, head plate 22, and rotary drive table assembly 23. A portion of mast 17 at 25 extends below hinge joint 14 and connects to guide plate 21. Both mast 17 and feed frame assembly 18 are pivotable independently about hinge joint 14. An appropriate locking assembly is engageable to lock mast 17 with feed frame assembly 18 so that they may be pivoted as a unit. In the fully operational condition, the entire mast assembly 13 is locked in the vertical position as shown in FIG. 1.

Automatic drive hammer system 10 includes a support bucket 26, an upper stop bracket 27, a winch assembly 28, and an automatic drive hammer apparatus 30. Bucket 26 is rigidly secured as by welding to axle member 31 which is journaled about its axis by upper and lower axle sleeves 32 and 33, respectively. Upper sleeve 32 is held rigidly in position by upper sleeve bracket 34 which in turn wraps around behind feed hydraulic cylinder 20 and is fixed in an appropriate manner to lower mast section 25. Lower sleeve 33 is held rigidly in place by a pair of lower sleeve bracket members 35 which are welded thereto and to guide plate 21. (See FIG. 2). Appropriate axle end pieces 36 and 37 are secured to axle member 31 above and below upper and lower sleeve 32 and 33, respectively.

Figure 2:
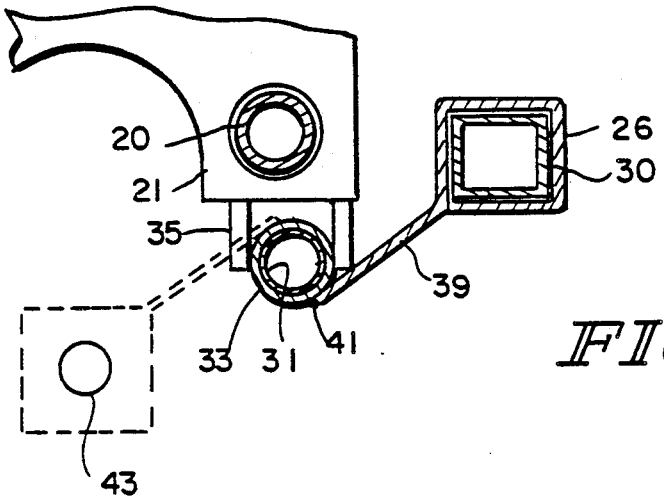
FIG. 2 is a cross-sectional view of the drive hammer system of FIG. 1 taken along the lines 2—2 and viewed in the direction of the arrows.

Referring to FIG. 2, support bucket 26 has a rectangular cross-section sized to telescopically receive therein the rectangular cross-sectionally shaped bottom portion of automatic drive hammer apparatus 30. Support plate 39 extends at an angle from the rectangular body portion of bucket 26 and is welded at 41 to lower axle sleeve 33. As shown in FIGS. 1 and 2, bucket 26 and drive hammer apparatus 30 are in an off-hole position. Bucket 26 may be pivoted, with or without drive hammer apparatus contained therein, to and from an on-hole position which is shown in dashed lines in FIG. 2. In the on-hole position, bucket 26 is positioned roughly over the drill string 43 or other member which extends upwardly from the ground. Although, when drive hammer apparatus 30 is in bucket 26, pedestal 67 of anvil 56 of drive hammer apparatus 30 (as will be described in detail herein) is also positioned roughly over drill rod 43, drive hammer apparatus is not in an operating position, but rather in the loading/unloading position. As will be described, drive hammer apparatus 30 must be lifted out of bucket 26 from this loading/unloading position by activation of winch assembly 28, whereby bucket 26 is then swung back to the off-hole position. The resulting operating position has bucket 26 empty and in the off-hole position while drive hammer apparatus 30 is held suspended by winch assembly 28 in the on-hole position poised for operation. A handle 45 is provided on one side of drive hammer apparatus 30 to facilitate maneuvering of apparatus 30.

Figure 3:
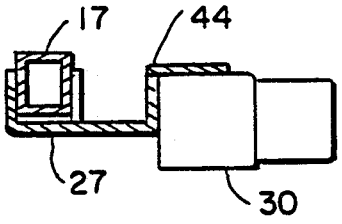
FIG. 3 is a cross-sectional view of the drive hammer system of FIG. 1 taken along the lines 3—3 and viewed in the direction of the arrows.

Referring to FIGS. 1 and 3, upper stop bracket 27 is provided for stability in the storage position. Bracket 27 is fixed as by welding to mast 17. Bracket 27 extends to an L-shaped portion 44 adapted to receive and act as a stop for the upper portion of drive hammer apparatus 30 when pivoted with bucket 26 to the storage position. Further, when the entire mast assembly 13 is pivoted about hinge joint 14 to a horizontal, traveling position, the L-shaped portion 44 provides support for the upper half of drive hammer apparatus 30. A device to provide temporary securement of drive hammer apparatus 30 to bracket 27 may be used.

Winch assembly 28 includes a sheave 48 and cable 49 which extends around sheave 48 and connects at one end to a hook 50 on top of drive hammer apparatus 30. Cable 49 is intended to be secured to hook 50 at all times. A motor (not shown) controls the feed of cable 49 and thereby the appropriate raising and lowering of drive hammer apparatus 30.

Figure 4:
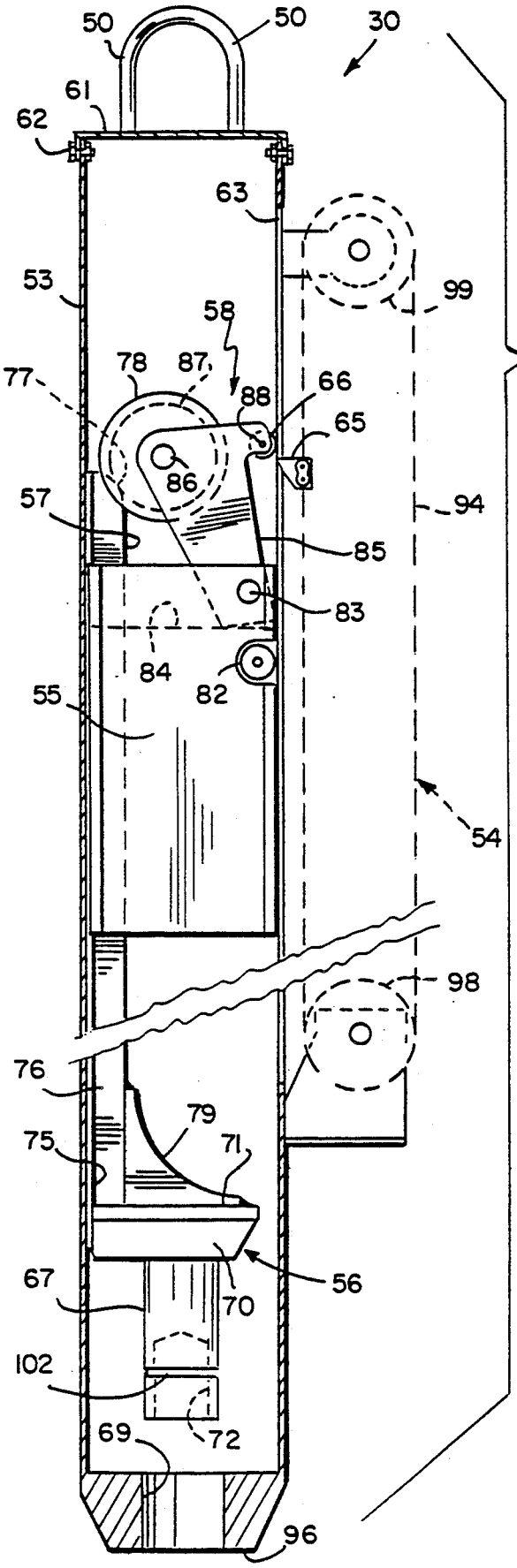
FIG. 4 is a partially cross-sectional view of the drive hammer apparatus of the drive hammer system of FIG. 1 showing the hammer and follower assembly at the top of their stroke.

Referring now to FIGS. 4 through 7, drive hammer apparatus 30 will now be described. Drive hammer apparatus 30 generally includes hammer case or housing 53, hammer drop system 54, hammer 55, anvil 56, trip rail 57 and follower assembly 58. Referring to FIG. 4, housing 53 is generally tubular with a rectangular cross-section. Cover plate 61 with suspension hook 50 is attached to housing 53 by appropriate fasteners 62. A slot 63 is defined along one side of housing 53 to permit engagement of chain pick-ups 65 with roller 66 of follower assembly 58. The bottom of housing 53 defines a hole 69 through which may extend the pedestal 67 of anvil 56 or the connector 68 which may be connected thereto (see FIG. 5).

Anvil 56 has an impact portion 70 with an upwardly facing impact surface 71. Pedestal 67 extends downwardly from impact portion 70 and defines a female pin connection cavity 72. Trip rail 57 has a generally T-shaped cross section (see FIG. 6) defined by a flat back plate portion 75 and a generally rectangular guide rail portion 76. At its top 77, guide rail portion 76 is rounded off to provide a gentle, but abrupt end for the wheel 78 of follower assembly 58. At the bottom, guide rail portion 76 abuts impact surface 71 while back plate portion 75 extends further downward along and adjacent the back of impact portion 70. Back plate portion 75 and guide rail portion 76 are rigidly secured to impact portion 70 as by welding. Further support is provided between impact portion 70 and trip rail 57 by the welding therebetween of gusset 79.

Figure 6:
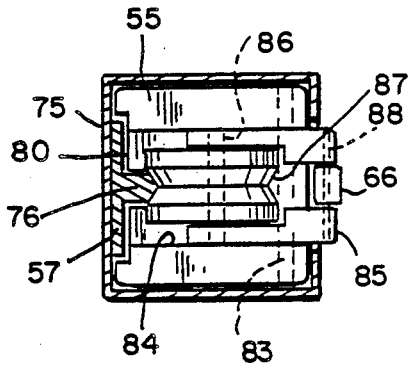
FIG. 6 is a cross-sectional view of the drive hammer apparatus of FIG. 5 taken along the lines 6—6 and viewed in the direction of the arrows.

Referring to FIGS. 4 and 6, hammer 55 is a generally rectangular 140±2 lb. (63.5±1 kg) slug. A T-shaped slot 80 is milled into hammer 55 to provide a complementary fit between hammer 55 and trip rail 57. Hammer 55 is also provided with one or more guide rollers 82 (one shown) on the side of hammer 55 opposite T-shaped slot 80. Rollers 82 reduce somewhat the frictional forces between hammer 55 and housing 53 as hammer slides therewithin. A toggle 85 of follower assembly 58 is pivotally mounted by pin 83 within transverse slot 84. Follower wheel 78 is journaled at one side of the top of toggle 85 by a pin 86. The circumferential surface of wheel 78 is grooved at 87 to snugly follow guide rail portion 76 of trip rail 57. Pick-up roller 66 is journaled at the opposite side of the top of toggle 85 by a pin 88. Hammer 55 further has a slot (not shown) milled out of its bottom to provide clearance for gusset 79 when hammer 55 falls against impact surface 71. It is the combined weight of hammer 55 and follower assembly 58 which totals 140±2 lb.

Figure 7:
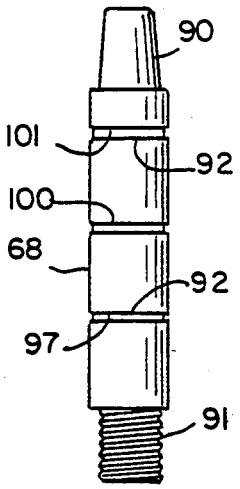
FIG. 7 is a side, elevational view of the connector of the drive hammer apparatus of FIG. 5.
Figure 5:
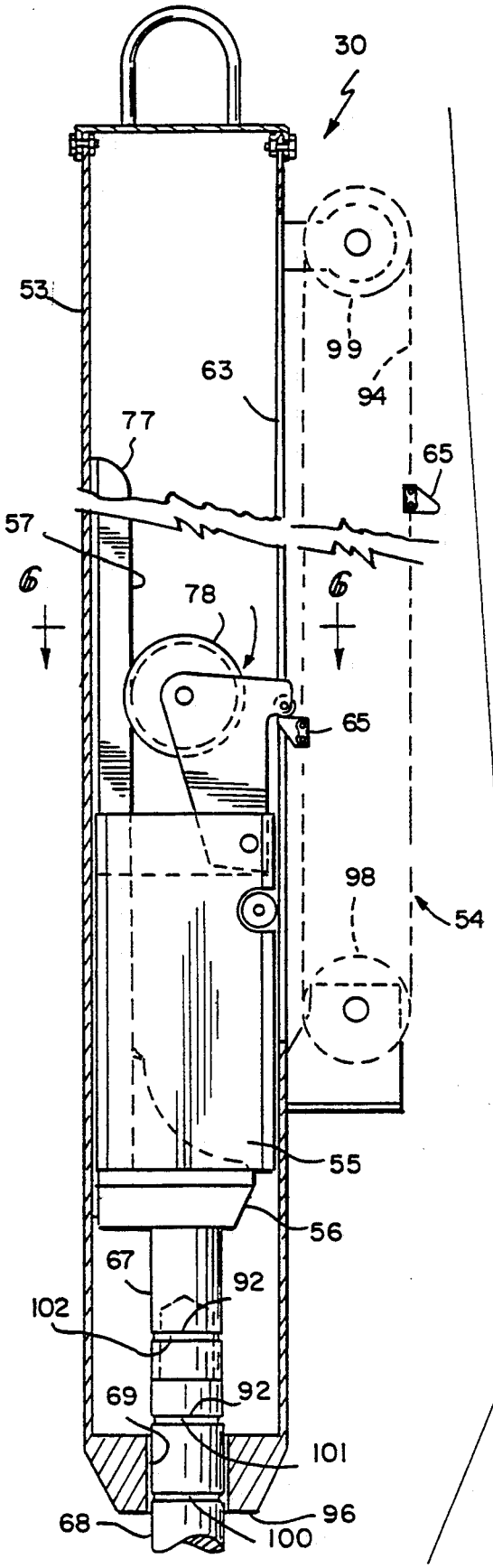
FIG. 5 is a partially cross-sectional view of the drive hammer apparatus of the drive hammer system of FIG. 1 showing the hammer and follower assembly at the bottom of their stroke.

Referring to FIGS. 4, 5 and 7, connector 68 has a generally circular cross-section and has a male pin connection fitting 90 at one end. Anvil 56 may be set on top of connector 68 by dropping it downward so that female cavity 72 of pedestal 67 coaxially fits over male fitting 90. The opposite end 91 of connector 68 is threaded for connection to the upper end of drill string 43 (FIG. 1). Connector 68 and the bottom of pedestal 67 are provided with external markings 92 such that, when connected (FIG. 5), each marking is 6 inches apart.

Hammer drop system 54 is standard and includes a hydraulically driven endless chain 94 with pick-ups 65. Chain 94 is mounted for rotation about a pair of sprockets 98 and 99. One of the sprockets 98 is hydraulically driven. There are two chain pick-ups 65 spaced halfway apart along and mounted to endless chain 94. Hammer drop system 54 is rigidly attached to the side of housing 53 and has a hammer drop system cover 95 (see FIG. 1).

In operation, automatic drive hammer system 10 is used as follows to perform a Standard Penetration Test. After a hole has been drilled, the drill string and drill bit combination is removed from the ground. An appropriate split-barrel sampler is connected to a string of sampling rods or the drill string 43 and lowered into the hole with a portion thereof extending up from the ground as shown in FIG. 1. Automatic drive hammer apparatus 30 in bucket 26 is swung from the storage position shown in FIG. 1 to the loading/unloading position shown in dashed lines in FIG. 2. Winch assembly 28 is engaged to lift drive hammer apparatus 30 out of bucket 26 and bucket 26 is then swung back to to the off-hole, storage position. Structurally, sheave 48 is mounted atop mast 17 so that when drive hammer apparatus 30 is hanging suspended from sheave 48, apparatus 30 hangs rearwardly away from the remainder of the drill rig components. Connector 68 is next threadedly, coaxially secured to drill string 43. At this point, anvil 56 is resting at the bottom of housing 53 with pedestal 67 extending through hole 69 and below housing 53. Also, hammer 55 is resting atop impact portion 70 of anvil 56. Next, winch assembly 28 is activated, lowering drive hammer apparatus 30 toward connector 68 until pedestal 67 of anvil 56 engages connector 68 with male fitting 90 entering female cavity 72. At this point, the weight of anvil 56, trip rail 57, hammer 55, follower assembly 58 and connector 68 is all that is resting upon drill rod 43. The weight of housing 53 and the hammer drop system 54 is all supported by winch assembly 28, completely off of drill string 43. Winch assembly 28 is further actuated to lower housing 53 and hammer drop system 54 so that the bottom-most horizontal edge 96 of housing 53 is roughly in line with the bottom-most external marking 97 of connector 68.

Drive hammer system 10 is now in the fully operating position ready to conduct a Standard Penetration Test in a desired manner such as in accordance with ASTM Standard D1586-84. In operation, automatic drive hammer apparatus 30 operates as follows:

Hammer drop system 54 is engaged whereby endless chain 94 begins to run about sprockets 98 and 99 in a clockwise direction. With hammer 55 resting atop anvil 56, wheel 78 is engaged with the inner side of guide rail portion 76 which causes toggle 85 to be pivoted toward hammer drop system 54. A portion of toggle 85 and thereby roller 66 extends outwardly through slot 63. Thus, as chain pick-up 65 rounds sprocket 98 on the inner path of chain 94 and moves toward sprocket 99, it will engage roller 66, lifting toggle 85 and hammer 55. Since housing 53 and hammer drop system 54 are held completely suspended by winch assembly 28, the entire weight of hammer 55 and follower assembly 58 along with the force of lifting hammer 55 and follower assembly 58 is borne by winch assembly 28. As hammer 55 is lifted by chain pick-up 65, wheel 78 follows guide rail 57 as shown in FIG. 5. As wheel 78 reaches the rounded top 77 of guide rail portion 76, toggle 85 may pivot about pin 83 away from hammer drop system 54 whereby roller 66 falls away from its engagement with chain pick-up 65. Pick-up 65 continues to move toward sprocket 99 and the combination of hammer 55 and follower assembly 58 free falls downward and hammer 55 strikes impact surface 71 of anvil 56, which force is transmitted to drill string 43 and the sampler connected thereto. By the time hammer 55 strikes anvil 56, the second chain pick-up 65 has rounded lower sprocket 98 and is about to engage follower assembly 58 for the subsequent hammer drop cycle.

Trip rail 57 is sized appropriately relative to hammer drop system 54, hammer 55 and follower assembly 58 such that when roller 78 reaches top 77 of guide rail portion 76 and falls away from its engagement with pick-up 65, hammer 55 will fall therefrom 30±1 inch (0.76 m±25 mm) as required by the Standard Penetration Test.

When hammer 55 strikes anvil 56, drill string 43 and the sampler connected thereto is customarily driven incrementally into the ground. As drill string 43 is driven downward, connector 68, anvil 56 and trip rail 57 drop therewith. The 30±1 inch drop height of hammer 55 is governed by trip rail 57 which is fixedly attached to anvil 56. The drop height thus remains constant for each drop cycle regardless of the position of the chain and pick-up assembly 54. As the test continues and drill string 43, connector 68 and anvil 56 are driven downward, markings 92 on connector 68 and pedestal 67 drop relative to housing 53 which remains vertically stationary. Since the test was begun with lowermost marking 97 even with bottom edge 96 of housing 53, when the next marking 100 is seen to be even with bottom edge 96, the operator will know that drill rod string 43, connector 68 and anvil 56 have been driven six inches downward (since the markings 92 are spaced six inches apart). This event will signal the end of the first part of the Standard Penetration Test. The second part may be conducted in the same manner as the first with the next line 101, six inches above line 100, signaling the end of the second part of the test. The end of the final or third part of the test is signaled by the uppermost line 102, which is six inches above line 101.

As seen from the above description, the present invention permits performance of the Standard Penetration Test with only minimal weight being allowed to rest on drill string 43. Also, the anvil, drill string and sampler combination is free to drop downwardly great distances on each hammer blow, yet the 30 inch drop height remains constant without ever having to reposition housing 53. Theoretically, the anvil, drill string and sampler combination could be driven the entire 24 inches in one drop cycle.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for driving a drill rod into the earth, comprising the steps of:

providing an automatic drive hammer system mounted for operation from an earth drilling rig having a drill rod feed mechanism support structure, said system including:

a support bucket pivotally mounted to the support structure for movement between an on-hole position and an off-hole position, an automatic drive hammer apparatus having a housing, an anvil and a hammer, the anvil adapted for connection to a drill rod, the hammer adapted for reciprocal sliding movement within said housing to cyclically strike the anvil and drive the drill rod into the earth, a winch assembly disposed for operation from high atop the support structure, said winch assembly including a cable having a distal end constantly connected to said drive hammer apparatus, and wherein the drive hammer system has a storage position wherein said drive hammer apparatus sits within said bucket and said bucket is in the off-hole position, a loading/unloading position wherein said drive hammer apparatus sits within said bucket and said bucket is in the on-hole position, and an operating position wherein said drive hammer apparatus is suspended by said winch assembly in the on-hole position out of said bucket and said bucket is in the off-hole position;

pivoting said bucket whereupon the drive hammer system is put in the loading/unloading position from the storage position;

operating in one manner said winch assembly whereby said drive hammer apparatus is lifted out of said bucket;

pivoting said bucket to the off-hole position with said drive hammer apparatus staying in the on-hole position and whereupon the drive hammer system is put in the operating position;

operating in another manner said winch assembly whereby said drive hammer apparatus is lowered to a predetermined height above the drill rod and the anvil is connected to the drill rod; and, operating said drive hammer apparatus to cyclically drop said hammer onto the anvil.

2. The method for driving a drill rod into the earth of claim 1 wherein during said operating said drive hammer apparatus step, said housing remains substantially vertically stationary.

3. The method for driving a drill rod into the earth of claim 1 further including the step of providing a connector adapted for mounting atop the drill rod, and including the step of mounting the connector atop the drill rod, and wherein said operating in another manner step includes mounting the anvil atop the connector after lowering said drive hammer apparatus.

4. The method for driving a drill rod into the earth of claim 1 wherein the anvil has an impact portion slidable within said housing and wherein said providing an automatic hammer system step includes said system including a trip rail being connected to the anvil to slide as a unit with the impact portion within said housing and including lifting means mounted to and alongside of said housing for cyclically engaging with and lifting said hammer.

5. The method for driving a drill rod into the earth of claim 1 wherein said trip rail has a top end and wherein said automatic drive hammer system further includes follower means connected to said hammer and for disengaging said lifting means from said hammer when said follower means reaches the top end of said trip rail.

6. The method for driving a drill rod into the earth of claim 5 wherein said follower means includes a toggle pivotally mounted to said hammer, a follower wheel journaled to the toggle and a roller journaled to the toggle, said lifting means engaging the roller to lift said hammer and wherein said toggle pivots away from and disengages from said lifting means when the follower wheel reaches the top end of said trip rail.

7. An automatic drive hammer system adapted for operation form an earth drilling rig having a drill rod feed mechanism support structure, the system comprising a support bucket pivotally mounted to the support structure for movement between an on-hole position and an off-hole position, a winch assembly disposed for operation from high atop the support structure, said winch assembly including a cable having a distal end, and an automatic drive hammer apparatus including a housing having a suspension hook and a reciprocable hammer weight configured to slide within the housing to strike an anvil and drive a drill rod into the earth, the housing being configured to rest in the support bucket during movement of the support bucket between its on-hole and off-hole positions, the automatic drive hammer apparatus being coupled to the winch assembly by connection of the distal end of the cable and the suspension hook on the housing to permit movement of the housing and its hammer weight relative to the support structure as the support bucket moves between the on-hole and off-hole positions.

8. The automatic drive hammer system of claim 7, wherein said automatic drive hammer apparatus further includes an anvil with an impact portion slidable within said housing, a trip rail connected to said anvil to slide as a unit with the impact portion within said housing, and lifting means mounted to and alongside of said housing for cyclically engaging with and lifting said hammer.

9. The automatic drive hammer system of claim 8, wherein said trip rail has a top end and wherein said automatic drive hammer system further includes follower means connected to said hammer for disengaging said lifting means from said hammer when said follower means reaches the top end of said trip rail.

10. The automatic drive hammer system of claim 9, wherein said follower means includes a toggle pivotally mounted to said hammer, a follower wheel journaled to the toggle and a roller journaled to the toggle, said lifting means engaging the roller to lift said hammer, and wherein said toggle pivots away from and disengages from said lifting means when the follower wheel reaches the top end of said trip rail.

11. The automatic drive hammer system of claim 10, wherein said toggle is mounted to the top of said hammer.

12. The automatic drive hammer system of claim 8 further including indicator means on the anvil and drill string for indicating when the drill rod has been driven a predetermined distance into the ground.

13. The automatic drive hammer system of claim 12 wherein said automatic drive hammer apparatus further includes an anvil with an impact portion slidable within said housing and a connector member adapted for mounting atop the drill rod, said anvil configured to be mounted atop the connector and wherein said indicator means includes at least two vertically spaced-apart lines visible on the exterior of said connector.

14. The automatic drive hammer system of claim 1 wherein during operation of said drive hammer apparatus, said housing is held from the drill rod by said suspension hook.

15. An automatic drive hammer system adapted for operation from an earth drilling rig having a drill rod feed mechanism support structure, the system comprising;

a support bucket pivotally mounted to the support structure for movement between an on-hole position and an off-hole position;

an automatic drive hammer apparatus comprising a housing with a suspension hook, a hammer weight mounted for reciprocal sliding movement within said housing to cyclically strike an anvil and drive a drill rod into the earth;

a winch assembly disposed for operation from high atop the support structure, said winch assembly including a cable having a distal end constantly connected to the hook of said drive hammer apparatus; and, wherein the drive hammer system has a storage position, a loading/unloading position and an operating position, the storage position including said drive hammer apparatus sitting within said bucket and said bucket being in the off-hole position, the loading/unloading position including said drive hammer apparatus sitting within said bucket and said bucket being in the on-hole position, and the operating position including said drive hammer apparatus being suspended by said winch assembly in the on-hole position out of said bucket and said bucket being in the off-hole position, and further including an upper stop bracket mounted to the support structure for stabilizing said drive hammer apparatus in the storage position.

16. An automatic drive hammer system adapted for operation from an earth drilling rig having a drill rod feed mechanism support structure, the system comprising;

a support bucket pivotally mounted to the support structure for movement between an on-hole position and an off-hole position;

an automatic drive hammer apparatus comprising a housing with a suspension hook, a hammer weight mounted for reciprocal sliding movement within said housing to cyclically strike an anvil and drive a drill rod into the earth;

a winch assembly disposed for operation from high atop the support structure, said winch assembly including a cable having a distal end constantly connected to the hook of said drive hammer apparatus; and, wherein the drive hammer system has a storage position, a loading/unloading position and an operating position, the storage position including said drive hammer apparatus sitting within said bucket and said bucket being in the off-hole position, the loading/unloading position including said drive hammer apparatus sitting within said bucket and said bucket being in the on-hole position, and the operating position including said drive hammer apparatus being suspended by said winch assembly in the on-hole position out of said bucket and said bucket being in the off-hole position, wherein said automatic drive hammer apparatus further includes an anvil with an impact portion slidable within said housing, a trip rail connected to said anvil to slide as a unit with the impact portion within said housing, and lifting means mounted to and alongside of said housing for cyclically engaging with and lifting said hammer weight.

17. The automatic drive hammer system of claim 16 wherein during operation of said drive hammer apparatus, said housing is held from the drill rod by said suspension hook.

18. The automatic drive hammer system of claim 16 wherein said trip rail has a top end and wherein said automatic drive hammer system further includes follower means connected to said hammer weight and for disengaging said lifting means from said hammer when said follower means reaches the top end of said trip rail.

19. The automatic drive hammer system of claim 18 wherein said follower means includes a toggle pivotally mounted to said hammer weight, a follower wheel journaled to the toggle and a roller journaled to the toggle, said lifting means engaging the roller to lift said hammer weight and wherein said toggle pivots away from and disengages from said lifting means when the follower wheel reaches the top end of said trip rail.

20. The automatic drive hammer system of claim 19 wherein said toggle is mounted to the top of said hammer weight.

21. The automatic drive hammer system of claim 16 further including indicator means on the anvil and drill string for indicating when the drill rod has been driven a predetermined distance into the ground.

22. The automatic drive hammer system of claim 21 wherein said automatic drive hammer apparatus further includes an anvil with an impact portion slidable within said housing and a connector member adapted for mounting atop the drill rod, said anvil adapted for mounting atop the connector and wherein said indicator means includes at least two vertically spaced-apart lines visible on the exterior of said connector.

23. An automatic drive hammer apparatus, comprising:

a tubular housing;

a hammer disposed for reciprocal sliding movement within said housing;

an anvil having an impact portion slidable within said housing;

a trip rail connected to said anvil and adapted to slide as a unit with the impact portion and within said housing, said trip rail having a top end;

lifting means mounted to and alongside of said housing for cyclically engaging with and lifting said hammer; and follower means connected to said hammer and for disengaging said lifting means from said hammer when said follower means reaches the top end of said trip rail.

24. The automatic drive hammer apparatus of claim 23 wherein said follower means includes a toggle pivotably mounted to said hammer and a follower wheel journaled to said toggle, said wheel adapted to follow said trip rail.

25. The automatic drive hammer apparatus of claim 24 wherein said lifting means includes an endless chain with at least one chain pick-up adapted to engage and lift said toggle so long as said wheel is below the top of said trip rail.

26. The automatic drive hammer apparatus of claim 25 wherein said housing is held suspended in a substantially constant vertical position during operation of the drive hammer apparatus.

27. The automatic drive hammer apparatus of claim 24 wherein said toggle is mounted to the top of said hammer.

28. The automatic drive hammer apparatus of claim 24 further including a roller journaled to the toggle and wherein said lifting means is adapted to engage the roller to lift said hammer and wherein said toggle pivots away from and disengages from said lifting means when the follower wheel reaches the top end of said trip rail 29. An apparatus for taking soil samples used in conjunction with an earth drilling rig for drilling a hole in earth comprising a support structure positioned in fixed relation to a hole in the earth, an automatic drive hammer having a housing surrounding a hammer disposed for cyclical movement within the housing, winch means for lifting the automatic drive hammer, the winch means including a mast assembly pivotally mounted on the support structure, and bucket means for supporting the automatic drive hammer, said bucket means being pivotally mounted on the support structure for movement between an on-hole position located above the hole and an off-hole position away from the hole so that the bucket means and the automatic hammer supported by the bucket means can be swung from the off-hole position away from the hole to the on-hole position above the hole, the winch means can be engaged to lift the automatic hammer out of the bucket means, and the bucket means can be swung back to the off-hole position away from the hole.

30. The apparatus of claim 29, further comprising an upper stop bracket mounted to the support structure to stabilize the drive hammer supported by the bucket means in its off-hole position.

31. The apparatus of claim 29, wherein the automatic drive hammer includes an anvil with an impact portion slidable within said housing a trip rail connected to said anvil to slide as a unit with the impact portion within said housing, and lifting means mounted to said housing for cyclically lifting said hammer.

32. An automatic drive hammer apparatus, comprising a hammer disposed for vertical reciprocating movement within a housing, means for dropping the hammer to impact and downwardly drive an anvil situated below the hammer, said dropping means including a rail attached to the anvil, means for connecting the hammer to the rail, lifting means for lifting the connecting means to lift the hammer vertically upward along the rail, and the rail being configured to provide trip means for guiding the connecting means to a point disconnecting the connecting means from the lifting means to allow the hammer to fall from a predetermined height above the anvil and impact the anvil.

33. The apparatus of claim 32, wherein the lifting means includes a rotating chain in fixed connection with the housing and positioned for continuous rotation within the housing, a toggle attached to the hammer, and means for engaging the toggle and the rotating chain to lift the hammer.

34. The apparatus of claim 33, wherein the trip means includes follower means for following the rail connected between the hammer and the rail, and means for disengaging the toggle form the rotating chain when the follower means reaches a predetermined position relative to the rail.

35. The apparatus of claim 32, wherein the anvil includes an impact portion slidable within the housing and the trip rail is connected to the anvil to slide as a unit with the impact portion within the housing.

36. The apparatus of claim 32, wherein the lifting means is mounted to and alongside said housing to cyclically engage and lift the hammer.

37. The apparatus of claim 32, wherein the trip rail has a top end and the trip means includes follower means connected to the hammer for disengaging the lifting means from the hammer when the follower means reaches the top end of the trip rail.

38. The apparatus of claim 37, wherein the follower means includes a toggle pivotally mounted to the hammer, a follower wheel journaled to the toggle and a roller journaled to the toggle, the lifting means engages the roller to lift the hammer, and the toggle pivots away form and disengages the lifting means when the follower wheel reaches the top end of the trip rail.

39. The apparatus of claim 38, wherein the toggle is mounted to the top of the hammer.

* * * * *